United States Patent [19]

Kämmerling-Essmann

[11] Patent Number: 4,829,854

[45] Date of Patent: May 16, 1989

[54] CUTTING AND SCORING STRIP

[75] Inventor: Horst-Peter Kämmerling-Essmann, Wuppertal, Fed. Rep. of Germany

[73] Assignee: Essmann & Schaefer GmbH & Co. KG, Fed. Rep. of Germany

[21] Appl. No.: 10,290

[22] Filed: Feb. 2, 1987

[30] Foreign Application Priority Data

Feb. 27, 1986 [DE] Fed. Rep. of Germany ..... 3606315

[51] Int. Cl.[4] ..... B21K 5/20; B26F 1/44

[52] U.S. Cl. ..... 76/107 C; 76/DIG. 2; 83/652; 83/697

[58] Field of Search ..... 76/107 C, DIG. 2; 83/652, 701, 697

[56] References Cited

U.S. PATENT DOCUMENTS

| | | | |
|---|---|---|---|
| 1,095,116 | 4/1914 | Kaven | 76/107 C |
| 1,837,523 | 12/1931 | Braden | 76/107 C |
| 2,049,157 | 7/1936 | Deubel | 76/107 C |
| 2,191,709 | 2/1940 | Dedrick | 83/652 |
| 2,211,213 | 8/1940 | Lindholm | 83/652 |
| 2,276,376 | 3/1942 | Deubel | 76/107 C X |
| 2,491,665 | 12/1949 | Johnson | 76/107 C X |
| 2,713,902 | 7/1955 | Biss | 83/652 |
| 3,411,208 | 11/1968 | Malm | 83/652 X |
| 3,587,382 | 6/1971 | Boyd | 83/652 X |
| 3,974,564 | 8/1976 | Hough . | |

FOREIGN PATENT DOCUMENTS

| | | |
|---|---|---|
| 3101988 | 1/1981 | Fed. Rep. of Germany . |
| 1483301 | 6/1966 | France . |

*Primary Examiner*—Frank T. Yost
*Assistant Examiner*—Rinaldi Rada
*Attorney, Agent, or Firm*—Jones, Askew & Lunsford

[57] ABSTRACT

A cutting and scoring line consisting of a blade (1) of steel with a cut bevel (2) formed on one longitudinal side of the blade, and the blade (1) is hardened in the area of the bevel (2) and the bevel has a fine grind (5) in the hardened area (4) starting from the tip (3) of the bevel.

6 Claims, 1 Drawing Sheet

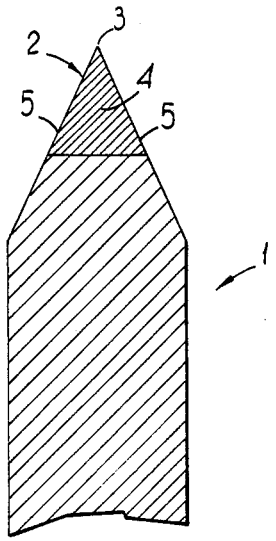
3
2
4
5
5
1

CUTTING AND SCORING STRIP

The present invention concerns a cutting and scoring consisting of a blade of steel with a cut bevel on one longitudinal side of the blade.

Such cutting and scoring strips are used in the paper processing and cardboard box industry.

Cutting and scoring strips are known which have either a ground bevel or a shaved or bevel. The ground bevel has a minimal negative crown, which yields an excellent sharpness, so a low punching pressure is necessary. However, the dimensional fidelity of such a bevel is not satisfactory for all purposes. Cut bevels have very good dimensional stability due to their production in a drawing process, so they can be used in applications where there are high demands of the measurement accuracy. Since the bevel is also slightly convex, however, the sharpness of this bevel is minor and it does not have a cutting action but instead has a pressing effect on the material, so higher punching pressures are necessary.

The present invention is based on the goal of creating a cutting and scoring strip which combines the advantages of the shaved bevel with the advantages of the ground bevel.

According to this invention, this is achieved by the fact that the blade is hardened at least in the area of the bevel and the bevel has a fine grind in the hardened area. This invention is based on the finding that due to the fine grind not only is an improved function of the cutting strip achieved due to the resulting change in shape, but also the dimensional accuracy of the cut bevel is not impaired due to the fine grind and on the other hand, the top layer of the bevel is worn away in a thickness which corresponds to the thickness of the soft outer skin which does not have the full desired hardness. Thus, according to this invention, an additional effect is achieved, because due to the fine grind according to this invention not only is the dimensional accuracy of the cut bevel retained, but also the cutting action of a ground strip is implemented, but in addition an increased lifetime is achieved.

On the basis of the practical example illutrated in the accompanied diagram, this invention is now described in greater detail.

The figure shows a cross section through a cutting and scoring strip according to this invention, consisting of a blade 1 with a bevel 2 along one longitudinal edge, but in the present example, there is a double-sided bevel 2. According to this invention, the bevel 2 is produced by the fact that the flat material of spring steel with a thickness of 0.4 to 2 mm is drawn in a hard metal draw die in such a way that a one-sided or two-sided bevel is created. Here it is customary to speak of a so-called cut bevel. According to this invention, this bevel is now produced with a certain excess in dimensions, namely with an excess of 2/100 to 4/100 mm. This cut bevel produced with the excess is then hardened in area 4, preferably by induction hardening with a depth of penetration of 3/10 to 5/10 mm, measured from the tip 3 of bevel 2. Hardening is done to a hardness of 66 HRc. After hardening, annealing is performed in the same area, namely to a final annealed hardness of 57 to 59 HRc. In addition, it is also provided according to this invention that the bevel 2 receives a fine grind 5. This fine grind 5 is executed in such a way at a grinding angle of ca. 45°–60° that the excess present after cutting is removed. At the same time, the softer outer skin of the hardened and annealed bevel is removed in this way. Due to this fine grind which is carried out to advantage with an added grinding disk, the dimensional accuracy of the cut bevel is not impaired, and furthermore, the fine grind prevents grooves from developing in the surface of the bevel.

The cutting and scoring strip according to this invention can be designed with a one-sided bevel, a two-sided bevel as shown here, a single-sided double-ground edge or with a quadruple ground edge. It is characterized by an increased lifetime in comparison with the known cutting and scoring strips as well as the fact that the shred effect that occurs with the known lines is avoided. In addition, the line according to this invention has an excellent dimensional stability which results in very short alignment times in the die.

I claim:

1. Cutting and scoring strip for cutting and scoring paper and cardboard or the like, comprising a blade of flat spring-steel cross bands and having a sharpened bevel on one longitudinal side of said blade, made by the process comprising the steps of forming said sharpened bevel with an overmeasure of 2/100 to 4/100 mm by a shaving process in which said blade is drawn in operative relation to a hard metal draw die, hardening said so-formed bevel in an area with a depth of penetration of 3/10 to 5/10 mm measured from the edge of said bevel, and finely grinding said bevel in the same area starting from the edge so that the overmeasure of 2/100 to 4/100 mm existing after said shaving process is removed.

2. Cutting and scoring strip according to claim 1, characterized by the fact that the hardened area is about 3/10 to 5/10 mm measured from the tip of the bevel.

3. Cutting and scoring strip according to claims 1, characterized by the fact that the hardness is ca. 66 HRc.

4. Cutting and scoring strip according to claim 1, characterized by the fact that the bevel is annealed in the hardened area, especially to a final hardness of ca. 57 to 59 HRc.

5. Cutting and scoring strip according to claim 1, characterized by the fact that the grinding angle of the fine grind is ca. 45° to 60°.

6. Cutting and scoring strip according to claim 1, characterized by the fact that the blade is made of spring steel with a thickness of 0.4 to 2 mm.

* * * * *